United States Patent [19]

Orita et al.

[11] Patent Number: 4,574,722

[45] Date of Patent: Mar. 11, 1986

[54] UNDERWATER CLEANING APPARATUS

[75] Inventors: Ryoji Orita; Shiro Shimatani; Hitoshi Okamoto, all of Tamano, Japan

[73] Assignee: Mitsui Engineering & Shipbuilding Co., Ltd., Tokyo, Japan

[21] Appl. No.: 720,457

[22] Filed: Apr. 5, 1985

Related U.S. Application Data

[63] Continuation of Ser. No. 535,959, Sep. 23, 1983, abandoned.

[30] Foreign Application Priority Data

Oct. 6, 1982 [JP] Japan ..... 57-151924[U]
Mar. 31, 1983 [JP] Japan ..... 58-56580

[51] Int. Cl.[4] ..... B63B 59/10
[52] U.S. Cl. ..... 114/222; 15/53 R
[58] Field of Search ..... 114/222, 312, 322; 15/1.7, 2 R, 28, 53 R, 87

[56] References Cited

U.S. PATENT DOCUMENTS 549,340 11/1895 Upham ..... 114/222
1,653,108 12/1927 Koenig ..... 15/28
3,436,782 4/1969 Ayala ..... 15/87
3,775,800 12/1973 Veneziani ..... 15/28
3,906,572 9/1975 Winn ..... 114/222
3,946,692 3/1976 Sierra ..... 114/222
4,052,950 10/1977 Hirata ..... 114/222
4,095,378 6/1978 Urakami ..... 114/222
4,271,557 6/1981 Caron ..... 15/28
4,275,474 6/1981 Woodward ..... 15/1.7
4,314,521 2/1982 Lundberg ..... 114/222
4,402,101 9/1983 Van Zyl ..... 15/1.7

*Primary Examiner*—Galen L. Barefoot
*Assistant Examiner*—Stephen P. Avila
*Attorney, Agent, or Firm*—Armstrong, Nikaido, Marmelstein & Kubovcik

[57] ABSTRACT

An underwater cleaning apparatus having a carrier, a plurality of wheels for shifting the position of the carrier along a submerged surface, a plurality of rotary brushes carried by the carrier and adapted to clean the submerged surface, and a source of power for rotating the rotary brushes. The apparatus further comprises flexible partition wall members for transmitting torque to the rotary brushes and forming reduced pressure chambers communicated with spaces formed by bristles of respective rotary brushes. As the rotary brushes rotate, the rotary brushes and the partition wall members in combination serve to provide vacuum to produce a force to press the carrier through the wheels onto the submerged surface to be cleaned. In addition, each of the rotary brushes are allowed to individually follow the configuration of the surface thanks to the flexibility of the partition wall members.

4 Claims, 6 Drawing Figures

UNDERWATER CLEANING APPARATUS

This application is a continuation of application Ser. No. 535,959, filed Sept. 23, 1983, now abandoned.

BACKGROUND OF THE INVENTION

The present invention relates to an underwater cleaning apparatus for cleaning underwater or submerged surfaces such as submerged surface of a ship's hull.

A known underwater cleaning apparatus for cleaning submerged surfaces has circular rotary brushes for cleaning the surface and a carrier carrying the rotary brushes and having wheels for driving the apparatus along the surface to be cleaned.

In the cleaning apparatus of the kind described, the wiping and cleaning performance of the rotary brushes is decreased almost to a half when the rotary brushes fail to follow up the configuration of the surface to be cleaned.

In addition, if the size of the apparatus as a whole is increased unlimitedly, the operation and handling of the apparatus by the diver will be seriously impaired.

SUMMARY OF THE INVENTION

Accordingly, it is a first object of the invention to provide an underwater cleaning apparatus having a higher wiping and cleaning efficiency.

It is a second object of the invention to provide an underwater cleaning apparatus the size and weight of which are reduced as much as possible to facilitate the handling thereof.

To these ends, the invention provides an underwater cleaning apparatus comprising a carrier, a plurality of wheels for shifting the position of the carrier along a submerged surface, a plurality of rotary brushes carried by the carrier and adapted to clean the submerged surface, driving means for rotating the rotary brushes, and flexible partition wall members for transmitting the torque of the driving means to the rotary brushes and forming reduced pressure chambers communicated with spaces surrounded by bristles of respective rotary brushes.

According to this arrangement, the flexible partition wall member advantageously permits the brushes to be clamped to the wall flexibly.

In consequence, the rotary brushes can well follow up the configuration of the surface to achieve a higher wiping and cleaning performance.

In addition, the suction force produced by the rotation of brushes is advantageously transmitted to the wheels through the carrier to pull the apparatus as a whole towards the surface to be cleaned.

Therefore, it is possible to obtain a sufficiently large force for pressing the wheels against the surface to be cleaned, without requiring any increase of the size of the rotary brushes and the power of the driving means.

Consequently, according to the invention, it is possible to use small rotary brushes and driving means, which in turn decreases the size and weight of the cleaning apparatus as a whole.

Preferably, the partition wall member is produced from a material such as synthetic rubber, synthetic resin or woven fabric with waterproofing treatment, into the form of bellows or a tire.

According to another feature of the invention, the rotary brushes have tufts of bristles provided on the front side of rotary discs, the tufts being arranged in spiral forms such that the areas wiped by adjacent tufts lap each other.

Above and other features of the invention will become more clear from the following description of typical preferred embodiments of the invention taken in conjunction with the accompanying drawings.

DESCRIPTION OF THE PREFERRED EMBODIMENTS

Figure 2:
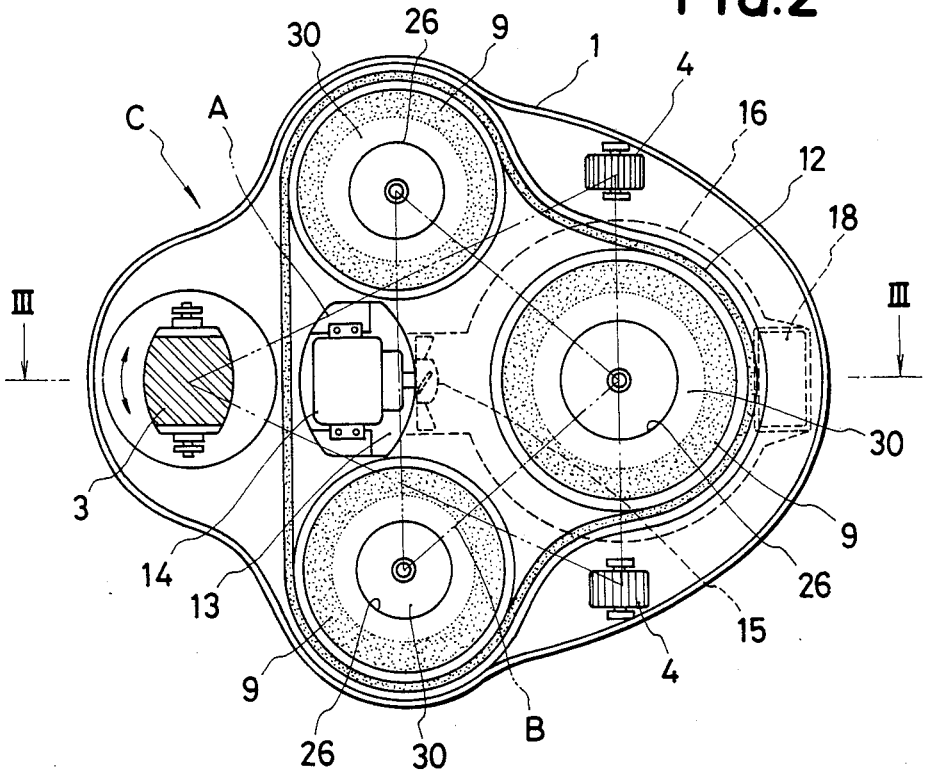
FIG. 2 is a bottom plan view of an underwater cleaning apparatus of the invention.

Referring first to FIG. 2, an underwater cleaning apparatus C of the invention has a carrier 1 carrying three rotary brushes 9, 9, 9 and having three wheels 3, 4, 4 among which two 4, 4 are free wheels while the remainder 3 is a driving and steering wheel. In order to achieve a parallel relation, as well as uniform stress distribution, the rotary brushes 9, 9, 9 and the wheels 3, 4, 4 are disposed at apices of imaginary triangles A and B, respectively.

Figure 3:
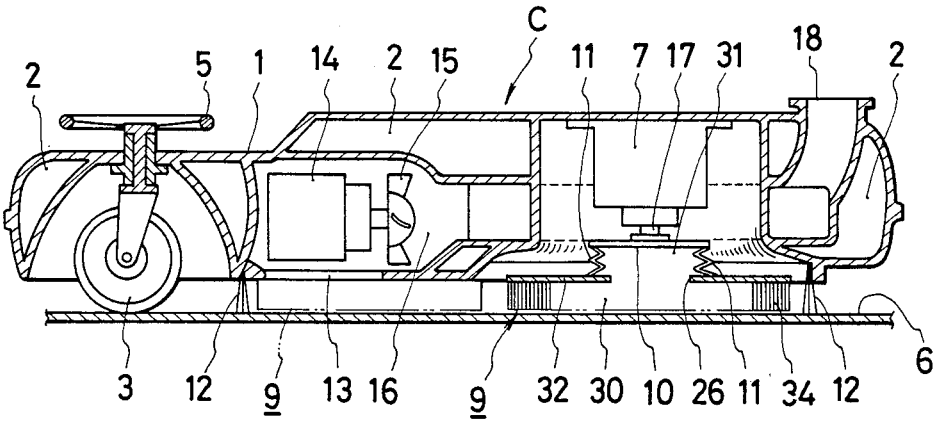
FIG. 3 is a sectional view taken along the line III—III of FIG. 2.

The carrier 1 is made of a light-weight material such as fiber-reinforced plastic, foamed urethane and light-metal. In order to obtain a buoyancy necessary for the operation by a diver D in a manner illustrated in FIG. 1, the underwater cleaning apparatus has a buoyancy tank 2 therein. As shown in FIG. 3, a steering handle 5 is connected to the upper end portion of the wheel 3.

Figure 5:
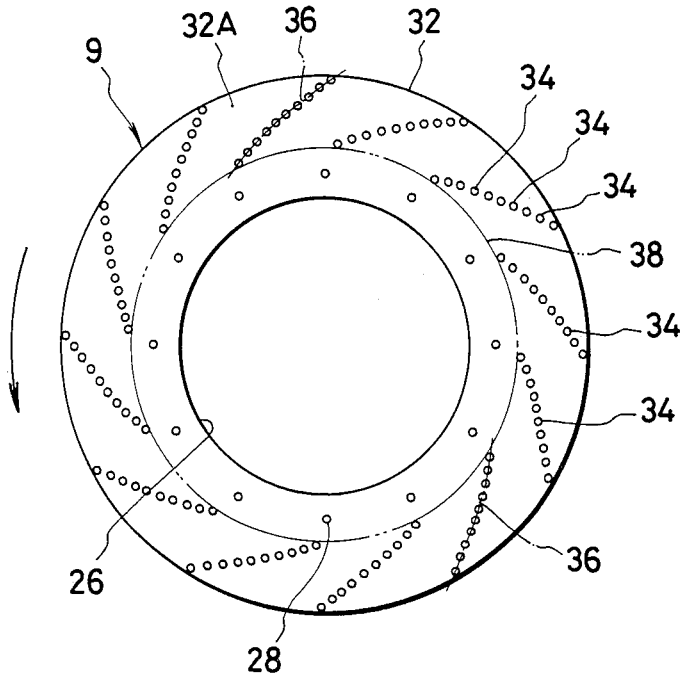
FIG. 5 is a bottom plan view of the rotary brush.

Referring now to FIG. 5, the rotary brush 9 has a so-called doughnut type disc 32 having a central communication hole 26, and a plurality of tufts 34 of bristles arranged along radial outward spiral lines 36 on the front surface 32A of the disc 32.

Accounting for the waterproofness and the workability, the disc 32 is usually made of a metallic material, although other materials such as wood, hard rubber, plastics and so forth can be used.

A reference numeral 28 designates a bolt hole for attaching the brush 9 to a partition wall member 11 which will be mentioned later.

The bristles constituting each tuft 34 are formed by bundling several tens of filaments of nonmetallic materials such as nylon, or flexible metallic wires.

Figure 6:
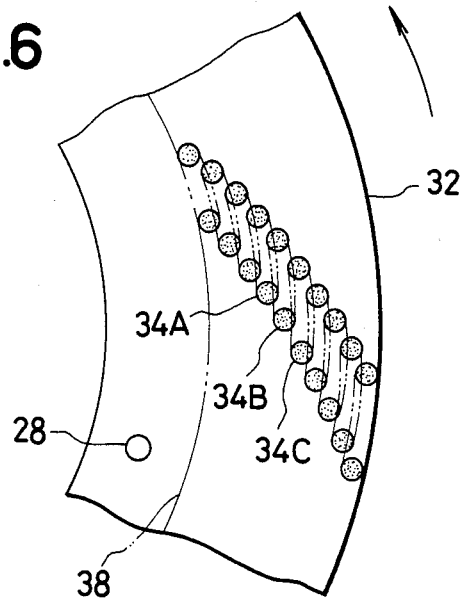
FIG. 6 is an enlarged view of a part of the rotary brush shown in FIG. 5.

As will be clearly seen from FIG. 6, the bristles of tufts 34 are arranged along rotary radial spiral lines 36 in the peripheral portion of the disc between the circle of [ radius 38 of the disc and the radially outer extremity of the same at constant pitches both in the radial and circumferential directions, in such a manner that the annular area wiped by a tuft 34B partially lap the areas wiped by adjacent tufts 34A and 34C.

Since the adjacent tufts cover adjacent areas partially lapping each other, it is possible to attain a sufficiently high wiping effect even with a small number of tufts 34 on the disc, and wiping failure is avoided even at a considerably high wiping speed. It is, therefore, possible to attain a remarkable effect to remove the marine growths attaching to the submerged surface 6 of the ship's hull 8 without fail.

The rotary brushes 9 are adapted to be driven by electric motors 7 which are fixed to the carrier 1. The rotary brushes 9 are attached, through bellows-type partition wall member 11, to supporting plates 10 which in turn are connected to the shafts 17 of the electric motors.

The partition wall member 11 defines therein a reduced pressure chamber 31 which in turn is communicated with a cavity or space 30 formed in the center of the rotary brush 9. The partition wall member 11 is required to transmit the torque of the electric motor 7 to the rotary brush 9 and to be deflected or flattened in the axial direction of the shaft 17 of the electric rotor 7 in accordance with the pressure in the reduced pressure chamber 31. To cope with these demands, the partition wall member preferably has a bellows-like form and is made from materials such as a synthetic rubber, synthetic resin or a material consisting mainly of woven fabrics with waterproofing treatment.

In operation, as the torque of the electric motor 7 is transmitted to the rotary brush 9 through the partition wall member 11, the water residing in the cavity or space 30 in the rotary brush, as well as in the reduced-pressure chamber, are discharged radially outwardly by the centrifugal force, so that the rotary brush 9 is attracted to make closer contact with the submerged surface 6 so as to effectively wipe and clean the submerged surface 6. At the same time, the vacuum generated in the reduced pressure chamber 31 produces a force which acts through the supporting plate 10, electric motor 7 and the carrier 1 on the wheels 3, 4, 4 thereby to press the latter onto the submerged surface 6.

Furthermore, the rotary brush 9 can follow up the configuration, i.e. convexities and concavities, of the submerged surface 6, because the rotary brush 9 is connected to the electric motor 7 through the flexible partition wall member.

Figure 4:
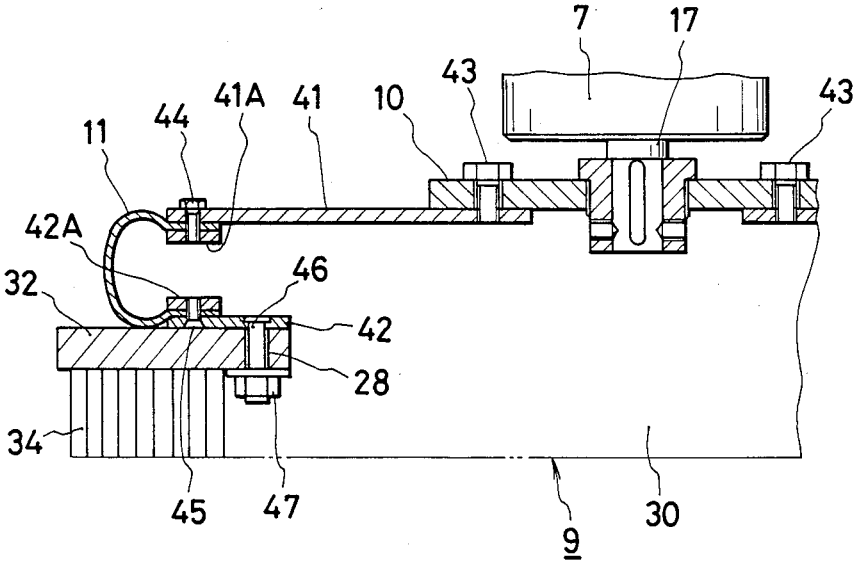
FIG. 4 is a sectional view of another example of the partition wall member.

FIG. 4 shows another example of the partition member 11 having a simplified construction. In this case, the partition wall member 11 has a form like bicycle's tire. The upper edge of the partition wall member 11 is clamped between a mounting member 41 and a pressing member 41A and fixed therebetween by means of screws 44, while the lower edge of the same is clamped and fixed between a mounting member 42 and a pressing member 42A by means of screws 45.

The upper mounting member 41 is fixed to the supporting plate 10 by means of bolts 43. On the other hand, the lower mounting member 42 is connected to the rotary brush 9 by means of bolts 46 and nuts 47.

Figure 1:
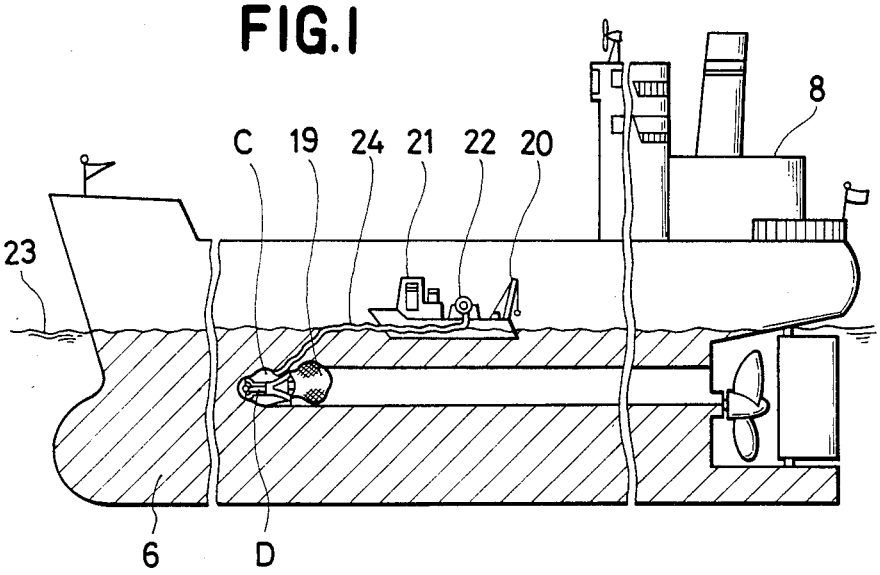
FIG. 1 is an illustration of the whole portion of an underwater cleaning apparatus which is being used to clean submerged surface of a ship's hull.

As shown in FIG. 3, three rotary brushes 9, 9, 9 are surrounded by an annular brush 12 constituted by bristles. A suction opening 13 leading to a passage 16 for collecting the marine growths detached by the brushes 9 is opened in the region surrounded by the annular brush 12. As will be understood from FIG. 3, the passage extends rearwardly and upwardly through the carrier 1. A discharge opening 18 of this passage is connected to a collecting network 19 as shown in FIG. 1.

A propeller 15, adapted to be driven by an electric motor 14, is disposed in the passage 16 so that the marine growths detached by the brushes 9 are sucked together with the water and are conveyed into the collecting network 19.

The electric power supplied to the motors 7 and 14 is produced by a generator 22 mounted on a vessel or floating platform 21 having a winch or a suitable lifting gear 20, through a power supply cable, 24. If the occasion demands, the land power may be supplied to the underwater cleaning apparatus C through a shore connection.

What is claimed is:

1. An underwater cleaning apparatus for cleaning a submerged surface comprising a carrier, a plurality of wheels for moving the carrier along a submerged surface, a plurality of rotary brushes for cleaning the submerged surface, and driving means for rotating each of said rotary brushes, said apparatus being characterized in that (a) each of said rotary brushes is connected to its associated driving means through a flexible annular bellows-type wall expandable towards and away from said submerged surface to define a reduced pressure chamber at the central axial region of said rotary brush, and (b) said plurality of rotary brushes are as a whole surrounded by an annular brush secured to said carrier.

2. An underwater cleaning apparatus according to claim 1, wherein each of said rotary brushes has tufts of bristle arranged on an annular disc along rotary radial spiral lines, the arrangement being such that the area wiped by one of said spiral line of bristles at least partially overlaps the area wiped by an adjacent line of tufts.

3. An underwater cleaning apparatus according to claim 1, wherein said flexible annular wall is pleated.

4. An underwater cleaning apparatus according to claim 1, wherein said flexible annular wall member has a tire-like form.

* * * * *